US007624685B2

(12) United States Patent
Andreasson et al.

(10) Patent No.: US 7,624,685 B2
(45) Date of Patent: Dec. 1, 2009

(54) GUIDEWAY AND CHASSIS SYSTEM FOR WHEEL BASED RAIL RUNNING VEHICLE

(75) Inventors: Ingemar Andreasson, Lundamo (NO); Andrew Howarth, South Yorkshire (GB); Hanyoung Choi, Seoul (KR); Christin Sangolt, Oslo (NO)

(73) Assignee: Posco Group Ltd., Seoul (KR)

( * ) Notice: Subject to any disclaimer, the term of this patent is extended or adjusted under 35 U.S.C. 154(b) by 358 days.

(21) Appl. No.: 10/555,959

(22) PCT Filed: May 7, 2004

(86) PCT No.: PCT/NO2004/000136

§ 371 (c)(1),
(2), (4) Date: Jan. 30, 2007

(87) PCT Pub. No.: WO2004/098970

PCT Pub. Date: Nov. 18, 2004

(65) Prior Publication Data

US 2007/0113754 A1 May 24, 2007

(30) Foreign Application Priority Data

May 7, 2003 (NO) ..... 20032053

(51) Int. Cl.
*E01B 25/00* (2006.01)

(52) U.S. Cl. ..... 104/130.07; 104/130.01

(58) Field of Classification Search ..... 104/242, 104/130.07, 130.09, 130.01
See application file for complete search history.

(56) References Cited

U.S. PATENT DOCUMENTS 3,712,238 A * 1/1973 Colovas et al. ..... 104/130.07
3,712,239 A * 1/1973 Colovas et al. ..... 104/130.07
3,831,527 A * 8/1974 Peterson ..... 104/130.07
3,841,225 A * 10/1974 Johnson ..... 104/130.01
3,845,719 A * 11/1974 Langdon ..... 104/130.07
3,977,487 A * 8/1976 Katayose et al. ..... 180/401

(Continued)

FOREIGN PATENT DOCUMENTS

EP 0 595 428 A1 5/1994

(Continued)

OTHER PUBLICATIONS

Magazine of "Mechanical Worker", Jun. 24, 1997.

*Primary Examiner*—S. Joseph Morano
*Assistant Examiner*—Jason C Smith
(74) *Attorney, Agent, or Firm*—Jacobson Holman PLLC

(57) ABSTRACT

A guideway and chassis system of wheel-based, rail running vehicles includes a guideway system having substantially horizontal bases, two parallel rails, and mainly vertical guide rails extending along both sides of the rails, with mainly horizontal inward flanges in a vertical distance above the bases. The chassis includes a set of main wheels arranged to run on the rails and a set of guide wheels arranged to bear against the guide rails to ensure the lateral position of the vehicle. The flanges are localized closely above the top side of the guide wheels to restrict the ability of the guide wheels to upward vertical movement. The width of the flanges is sufficiently small so as to not interfere with the main wheels, thereby allowing the top of the main wheels to extend above the horizontal flanges.

14 Claims, 3 Drawing Sheets

U.S. PATENT DOCUMENTS

| | | | | | |
|---|---|---|---|---|---|
| 4,183,304 | A * | 1/1980 | Forster | 104/247 |
| 4,265,180 | A * | 5/1981 | Uozumi | 104/247 |
| 4,267,779 | A * | 5/1981 | Binder | 104/247 |
| 4,436,170 | A * | 3/1984 | Mehren et al. | 180/401 |
| 4,522,128 | A * | 6/1985 | Anderson | 104/130.07 |
| 4,671,185 | A * | 6/1987 | Anderson et al. | 104/130.07 |
| 5,979,334 | A * | 11/1999 | Lund | 104/88.04 |
| 6,298,791 | B1 * | 10/2001 | Collins et al. | 104/243 |
| 6,308,636 | B1 * | 10/2001 | Collins et al. | 104/130.01 |
| 6,418,856 | B2 * | 7/2002 | Hossfield et al. | 104/130.01 |
| 6,857,374 | B2 * | 2/2005 | Novacek | 104/130.07 |
| 6,971,318 | B2 * | 12/2005 | Coakley | 104/130.07 |
| 2001/0039901 | A1 * | 11/2001 | Hossfield et al. | 104/130.07 |
| 2007/0113754 | A1 * | 5/2007 | Andreasson et al. | 104/242 |

FOREIGN PATENT DOCUMENTS

| | | | |
|---|---|---|---|
| EP | 0 595 434 | A1 | 5/1994 |
| EP | 0 595 435 | A1 | 5/1994 |
| WO | WO 86/07317 | | 12/1986 |
| WO | WO 86/07397 | | 12/1986 |
| WO | WO 87/04984 | | 8/1987 |
| WO | WO 88/06326 | | 8/1988 |
| WO | WO 01/56854 | A3 | 8/2001 |

* cited by examiner

GUIDEWAY AND CHASSIS SYSTEM FOR WHEEL BASED RAIL RUNNING VEHICLE

CROSS-REFERENCE TO RELATED APPLICATION

This is a nationalization of PCT/NO2004/000136 filed 7 May 2004 and published in English.

The present invention relates to a guideway and chassis (system) for wheel-based, rail-running vehicles. In particular the invention relates to a guideway and chassis for wheel based, rail-running vehicles intended for public transportation also denoted PRT (personal rapid transit).

BACKGROUND

1. Field of Invention

The need for effective transportation of people in urban regions throughout the world has been high and increasing for decades. Transportation by train, underground railways (metros), trolley cars and buses constitute supplementary networks of transportation in to and out from most large cities in the world. All of these categories of transportation have their advantages and drawbacks dependent on the actual situation, like the distances to cover, the amount of people in the region, the concentration of people in the region etc. In the later years it has become evident that a more personal based public transport system is demanded by people that else tend to use their private cars in urban district, with heavy traffic jams and pollution as unwanted side effects.

To meet this demand a network of rail tracks for comparatively small railway units need to be established. Such a system would comprise a comparatively high number of separate vehicles and therefore requires a very high degree of automation to make the system sufficiently reliable, safe, versatile and cost-effective.

One of the major challenges for such a system is to provide a guideway and chassis system that is simple and reliable, have low maintenance costs and where replacement of vehicles (units) is easy. The system should incorporate or allow easy switching for use in e.g. mesh type networks of guideways. The system should be reliable and safe in most weather conditions including heavy rain, snow and wind.

2. Description of the Prior Art

WO 01/56854 describes a prior art guideway and chassis system particularly intended for PRT. A chassis including main wheels, guide wheels, brakes and ramification wheels (switching wheels) mounted on a central, vertical main frame, is enclosed in a guideway system with a top slot that allows protrusion of the main frame up to a level where it may be connected to some kind of cabin (not shown) for the accommodation of passengers. This publication is mainly concerned with the ramification system, and how possible problems of snow, rain or ice on the guideway system are eliminated by its closed structure. Like some other priory known guideway and chassis systems for PRT it has the disadvantage that the central main frame that carries or supports all wheels, has to be comparatively high. Furthermore, any increase of the diameter of the main wheels is dependent on a vertical extension of the entire mainly closed structure.

OBJECTIVES

It is therefore an object of the present invention to provide a guideway and chassis system eliminating or reducing the disadvantages mentioned above.

It is a further object of the invention to provide such a guideway and chassis system that is suitable for use in all weather conditions, i.e. is able to work with a high degree of reliability and safety even in conditions of low temperatures and snow.

It is a still further object of the invention to provide such a guideway and chassis system that is suited for safe, comfortable and reliable public transportation, particularly for comparatively small vehicles associated with PRT.

It is a particular object of the invention to provide a guideway and chassis suited for mesh network guideway systems that can be trafficked at speed and under conditions that exclude conventional in-rail switching.

Finally, it is an object of the invention to provide a guideway system that is compact particularly with respect to its vertical extension, allowing it to be installed also directly on the ground without the need for high passenger platforms to the level of the vehicle floor and/or with a minimum of excavation required for its installation and with a minimum of visual interference/intrusion in the landscape through which the guideway is laid.

SUMMARY OF THE INVENTION

Preferred embodiments of the invention are as described herein.

The guideway and chassis system of the present inventions combines properties that make it safe and reliable in highly varying conditions. The main wheels transfer the weight from the vehicle to the rails of the guideway system. No braking forces are ever transferred by the main wheels, so they need not be designed for such a purpose. Thus the materials for the main wheels can be chosen independently of frictional properties and can be optimized for purposes of wear resistance and comfort, hereunder noise generation. Perhaps even more important, the size of the main wheels does not affect the height of the guideway structure, thus allowing larger, more economic and comfortable wheels without sacrificing the low, compact guideway structure.

The guide wheels in interaction with guide rails at both sides of the guideway, ensure the lateral position of the chassis and thereby of the vehicle at all times except when in switching zones. I.e. the guide wheels bear against the guide rails and thereby ensure that the main wheels are always maintained above a rail. No braking force is ever transferred by the guide wheels, so the material for the guide wheels may be optimized for other purposes, such as wear resistance and noise generation.

Except for their ability to rotate, the main wheels and the guide wheels may be rigidly connected to the chassis in one fixed position at all times. The front end and the tail end of the chassis may be constituted by two separate bogies, allowing the separate bogies to follow the bends of the guideway independently, thereby ensuring that the main wheels are parallel with the local portion of the trail even in sharp bends. This in turn is a requirement in order to keep the noise generation at a minimum in curved areas of the guideway, like station areas and switching points (the terms "switching points" and "switching zones" are used alternatingly in the description).

The chassis may, however, also have a much simpler design according to which the wheels are mounted on a "frame" part of the chassis that is rigidly fixed to the vehicle rather than on a pivotal "bogie". In this case the main wheels will always be parallel to the vehicle, and the minimum allowable curve radius of the guideway will necessarily be larger than for a system comprising vehicles with main wheels on pivotal bogies.

Securely attached to the upper edge of each guide rail, is an inwardly arranged flange that is designed and dimensioned for limiting the movement of the guide wheels in a vertical direction, i.e. in the unlikely situations that the vehicle tends to tilt. For this purpose the flange is positioned close above at least the outermost part of the guide wheels or at least one of the guide wheels at each side of the chassis, as the guide wheels need not all be arranged at the same vertical level. It is an essential feature of the invention that these horizontal flanges are not arranged so as to substantially cover the guideway, and more particularly are sufficiently narrow not to interfere with the main wheels, thus allowing the latter to be dimensioned independently of the vertical level at which said flanges are arranged.

The propulsion system is preferably an electrical one and more preferably constitutes a linear motor system (LIM) built into the guideway or the support structure of the guideway. Propulsion systems based on conventional friction drives may also be applied, but leads to less versatile systems that are not correspondingly well suited for highly automated systems. In case of a LIM, the propulsion force is transferred to the vehicle by means of at least one steel plate that is preferably rigidly attached between the main wheels below the chassis or constituting the lower part of the chassis. The steel plate may be faced with copper or aluminium to enhance the motor efficiency. Also braking forces involved in normal speed regulation are provided by the LIM system. Advantages of a LIM propulsion system where the motors are built into the guideway rather than arranged in the chassis/vehicles, are that there is no need to transfer power for propulsion to the vehicles, less fire hazard, less maintenance due to (less) contact wear, no dangerous open power rails and no problems of continuous contact through switching points of the guideway.

When using LIMs arranged in the guideway, in case of heavy snowfall the snow is most effectively removed by the heat of LIMs and by small ploughs in front of each vehicle provided vehicles are moving regularly. In case of snowfall during nighttime, empty vehicles should be directed to traffic the guideway network sufficiently regularly to avoid accumulation of significant amounts of snow on or between the rails.

When using LIMs arranged in the vehicles, which is also possible within the scope of the present invention, the required number of LIMs is evidently equal to the number of vehicles in the system (network), which will is significantly less than the number required when the LIMs are integrated in the guideway. On the negative side, transfer of power to the vehicles is required, as well as the other aspect mentioned above as positive aspects of the opposite arrangement.

When applied e.g. for public transportation, at least one additional braking system (emergency brakes) is required. Such a braking system may be a conventional one comprising callipers arranged to interact with at least one flange at each side of the chassis. Each braking flange may be the flange described which in interaction with at least one guide wheel on the relevant side ensures that no tilting movement of the vehicle is allowed. In order to keep the guideway as compact as possible, it is preferable that one and the same flange is used for both mentioned purposes. The emergency functionality of the brakes normally requires that they be arranged with pre-compressed mechanical springs or the like counteracted by a logically controlled mechanism ("watchdog") that requires a more or less continuous series of confirmatory signals to prevent the emergency brakes from being activated. If the confirmatory signals are interrupted for any reason, ranging from a stopped vehicle in front, power outage, a faulty sensor, a faulty processor or software or delayed communication, the emergency brakes are automatically engaged. It is emphasized, however, that such braking systems are known and do not as such constitute part of the present invention.

While particularly suited for public transportation the guideway and chassis according to the present invention may also be used for transporting goods in open air or within buildings.

Below the functions and details of the guideway and chassis system are described in further detail with reference to the enclosed drawings. Hereunder a detailed description of the switching features normally incorporated is given. It should be noted that all construction details that come in pairs, like rails, guide rails etc. generally are referred to by one common reference numeral for the pair. When one particular of the two in a pair is referred to, the appropriate index "R" (right) or "L" (left) is added. When an arbitrary of the two in a pair is referred to, the index "i" is added.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
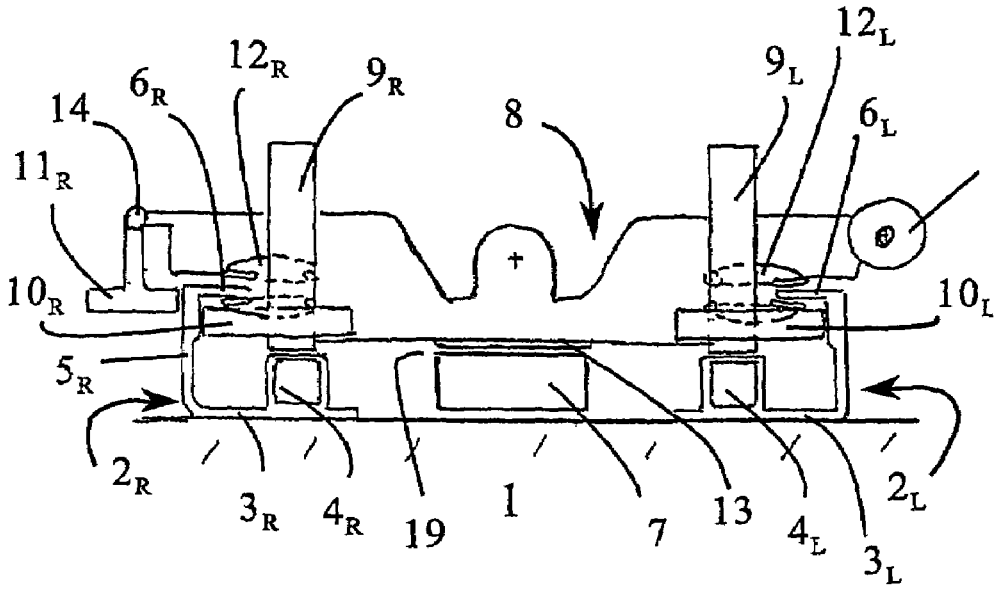
FIG. 1 is a front view of a preferred embodiment of the guideway and chassis system of the invention

FIG. 1 shows how a complex metal profile 2R and a metal profile 2L symmetrical with the metal profile 2R are attached to a support structure 1 that may either be a paved ground or an elevated structure made of steel, concrete or any other fit material. Each of the structures 2*i* comprise a substantially horizontal base 3*i*, a box-like structure that constitute a rail 4*i*, a substantially vertical part constituting a guide rail 5*i*, and an inward flange 6*i* that in the shown embodiment is substantially horizontal. The parts 2-6 comprises the main parts of what is generally denoted the guideway system. A linear motor 7, shown attached to the support structure 1 centrally between the profiles 2R and 2L, is the core element of the preferred propulsion system.

As mentioned the interaction between the guide wheels 10 and the guide rails 5 controls the lateral position of the vehicle. It is thus essential that the lateral distance between the rails 4 and the guide rails 5 is constant within acceptable tolerances. This may be obtained in different ways. According to a preferred embodiment this is obtained by arranging a rail and the adjacent guide rail as one integral unit. Another way of obtaining the same is to let the lower edge of each guide rail be substantially rigidly connected to a common support for the guideway system. A third way will be that the guide wheel is outwardly sprung against the guide rail.

Above and partly between the guideway central elements of a chassis and more precisely a bogie 8 is shown very simplified. The bogie 8 holds main wheels 9, guide wheels 10 and switching wheels 11. The main wheels 9 rest upon the rails 4. Although shown with a similar width in FIG. 1, it is evident that for safety reasons the width of the rails 4 may also be larger than the width of the main wheels. The guide wheels 10 bear against the upper part of each respective of the guide rails 5, the axis (not shown) of said guide wheels being substantially vertical. It should be emphasized that the lower part of each guide rail 5*i* need not be continuous in its horizontal extension, it is sufficient that the upper continuous part of each guide rail 5*i* is attached to the respective base 3*i* or a common support for the two at spaced intervals. The upper side of each of the shown guide wheels 10R, 10L are in close proximity of respective flange 6R and 6L respectively. An upward movement of any one of said guide wheels (10) caused by a beginning sideways tilting of a vehicle is thus effectively prevented or restricted.

Figure 2:
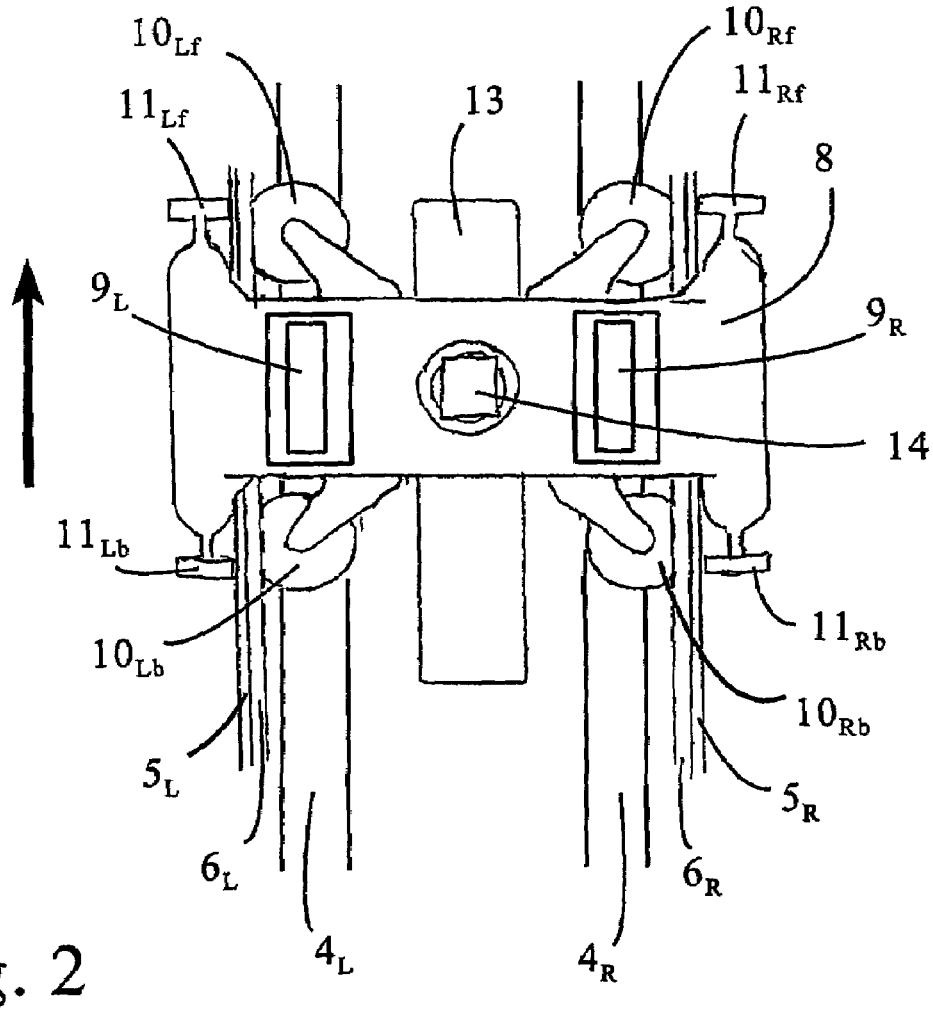
FIG. 2 is a top view of the guideway and chassis system shown in FIG. 1.

As seen from FIGS. 1 and 2 the flanges 6 do not have an extension that makes them interfere with the main wheels 9. In the embodiment shown in FIG. 1, the uppermost part of the guideway therefore is at a lower level than the top of the main wheel and even lower than the axis of the main wheel, which is highly contradictory to the construction shown in e.g. WO 01/56854. In FIG. 2 is shown how the main wheels 9R, 9L are arranged below openings in the bogie through which the wheels extend.

In FIG. 1 one of the switching wheels 11L is in a passive position, elevated above the guideway. The switching wheel 11R, however, is shown lowered to a position where its axis is vertical or nearly vertical and where it bears against the outer part of the guide rail 5R. In this position the bogie and consequently the vehicle is bound to follow the right hand guide rail but may and will leave the left hand guide rail if the distance between the right hand rail and the left hand rail increases, which is the case at every ramification (switching point) of the guideway. As the left hand guide rail 5L is shown in contact with left hand guide wheel 10L, the vehicle of FIG. 1 has not at the point depicted entered a switching zone.

The required movement of the switching wheels 11 between active and passive position may be performed in several ways, and should be designed in a manner ensuring high reliability and low wear. In the passive position the switching wheel 11 may rest above the guideway as shown by 11L in FIG. 1, the axis of the wheel pointing straight forward or backward along the guideway as better seen in FIG. 2. When the switching wheel 11 is to be moved to the active state, its axis is pivoted 90 degrees at a joint positioning the wheel as shown by 11R in FIG. 1. When the switching wheel is to revert to its passive position, the reverse movement of its axis is effected. The described changes of position can be achieved by various mechanical means, including but not limited to hydraulic equipment, tooth gears, electrical motors and actuators. As a safety precaution it is preferred that the switching wheels 11 are brought into an active position in a manner that does not possibly allow an outward horizontal movement of a switching wheel 11*i* from its active position, which is most easily obtained if the switching wheels during their activation are moved in a vertical plane parallel to—and slightly outside—the relevant guide rail 5*i*. In order to allow such a vertical movement into a close contact (abutment) with the guide rail without a squeak, it is convenient that the guide rail is thinner in the region where the switching wheels are activated than in the switching zones. The entire guide rail does not need to be thinner in said region, only its top part down to where the switching wheels engage it. A convenient way to practically design this feature is to arrange the upper part of the guide rail 5*i* thicker in the switching zones than in all other areas of the guideway system, and that the change of the guide rail from thin (or normal) to thick and back to thin again is made in a slow and gradual manner in tapered sections of the guide rail shortly before and shortly after each switching zone.

As elaborated further below, it is for many practical applications important that a control system be adapted to provide a positive confirmation whenever a switching wheel—or a pair of switching wheels is in its active state.

FIG. 1 also shows two pairs of callipers 12R and 12L arranged to open over part of the flanges 6R and 6L respectively to cause the braking action when actuated. The actuation of the callipers may be effected by a spring applied/hydraulically released system, and for safety reasons at least two independently working hydraulic circuits should be connected to at least some of the callipers.

FIG. 2 is a top view of a bogie and guideway like the one shown in FIG. 1, the direction of movement being as indicated with the bold arrow to the left. One difference from FIG. 1 is that the switching wheel 11L is in its passive state. It is also worth noting that in FIG. 2 the guide wheels and the switching wheels come in pairs. Thus instead of one left hand guide wheel 10L and one right hand guide wheel 10R, there are two left hand guide wheels 10Lf and 10Lb and two right hand guide wheels 10Rf and 10Rb. The switching wheels are also arranged similarly, so at each side there is one guide wheel 10Rf resp. 10Lf and one switching wheel 11Rf resp. 11Lf slightly in front of the main wheels 9 on the same bogie, and one guide wheel 10Rb resp. 10Lb and one switching wheel 11Rb resp. 11Lb slightly behind the same main wheels. This gives a particularly stable configuration of the bogie. It is to be understood that the chassis of a vehicle comprises two bogies, so with the configuration shown by FIG. 2 for both the front end bogie and the tail end bogie, the vehicle will hold 4 main wheels, 8 guide wheels and 8 switching wheels. It is not a requirement though that the tail end bogie is identical to or similar to the front end bogie with respect to the number of wheels.

Further to FIG. 2, it can be seen how the flanges 6 covers the outermost part of the guide wheels 10, thus restricting any beginning upward movement of the guide wheels 10 and thereby ensuring that the vehicle can not tilt. FIG. 2 also illustrates the relative proportion of the metal plate 13 that is attached to the underside of the bogie 8 in a manner allowing just a small air gap 19 between it and the linear motor 7. The pivotal attachment between the bogie and the compartment part of the vehicle is given reference numeral 14. It should be emphasized that it is not a requirement that any wheels are mounted on pivotal bogies, the wheels may also all be mounted on a fixed frame part of the chassis. The feature of the guide wheels (e.g. 10Rf and 10Rb) and switching wheels (e.g. 11Rf resp. 11Rb) coming in pairs is typical for assembly on a bogie and not required when the wheels are fitted to a fixed part of the chassis. Hence, an embodiment with wheel axises mounted to a fixed part of the chassis has the advantage of a reduced number of wheels and a much simpler overall design. On the negative side such a design does not allow sharp curves, and for vehicles with e.g. 1.8 meters axel centers the minimum curve radius will then be of a magnitude of 15 meters.

Figure 3:
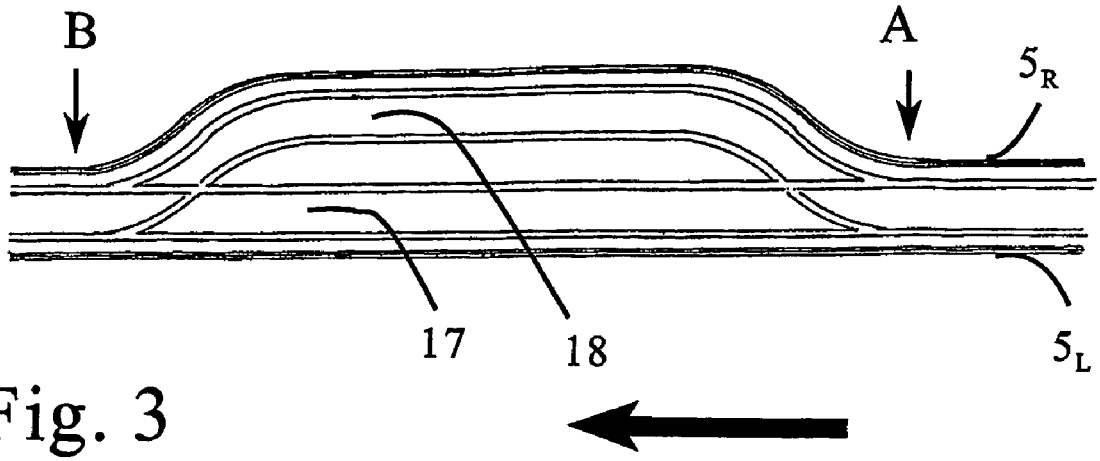
FIG. 3 is a top view of the guideway system according to the invention in a station area.

Now with reference also to FIG. 3 the function of the switching wheels is described in further detail. The travel direction is from right to left as shown by the bold arrow, and the guideway is split into a main track 17 and a side track or station track 18. At the point of the track split A the distance between the right hand guide rail 5R and the left hand guide rail 5L naturally starts to increase. From this point on the interaction between the guide wheels 10 and the guide rails 5 is no longer sufficient to ensure the lateral position of the vehicle on either of the tracks, since it is impossible for guide wheels 10R and 10L at both sides to bear against both guide rails 5R and 5L. Thus for a safe travel passed the station area on either of the tracks, it is necessary with additional positioning members as elaborated below.

A vehicle approaching the station area and more particularly the point A where the distance between he guide rails 5 starts to increase, must lower either the left hand switching wheels 11L to keep moving on the main track 17 or the right hand switching wheels 11R to move into the side track 18 and into the station. When the right hand switching wheels 11R are lowered, the right hand guide wheels 10R and the right hand switching wheels 11R bear tightly against the right hand guide rail 5R from both sides, and thus cause the vehicle to safely follow the rails of the side track 18 into the station. Correspondingly, if the left hand switching wheels 11L are lowered when the vehicle approaches point A, the combined action of the left hand guide wheels 10L and left hand switching wheels 11L against the left hand guide rail 5L, ensures that the vehicle safely follows the main track 17 passed the station area. The switching wheels 11*i* activated before approaching point A must remain in their active position until point B has been reached and the guide wheels 10R and 10L again will bear against the guide rails 5R and 5L at both sides.

At any switching point, not only station areas, the combined interaction of the guide wheels and the switching wheels at the side adjacent to the guide rail the vehicle is to follow, ensures the vehicle's lateral position passed the switching point.

Figure 4:
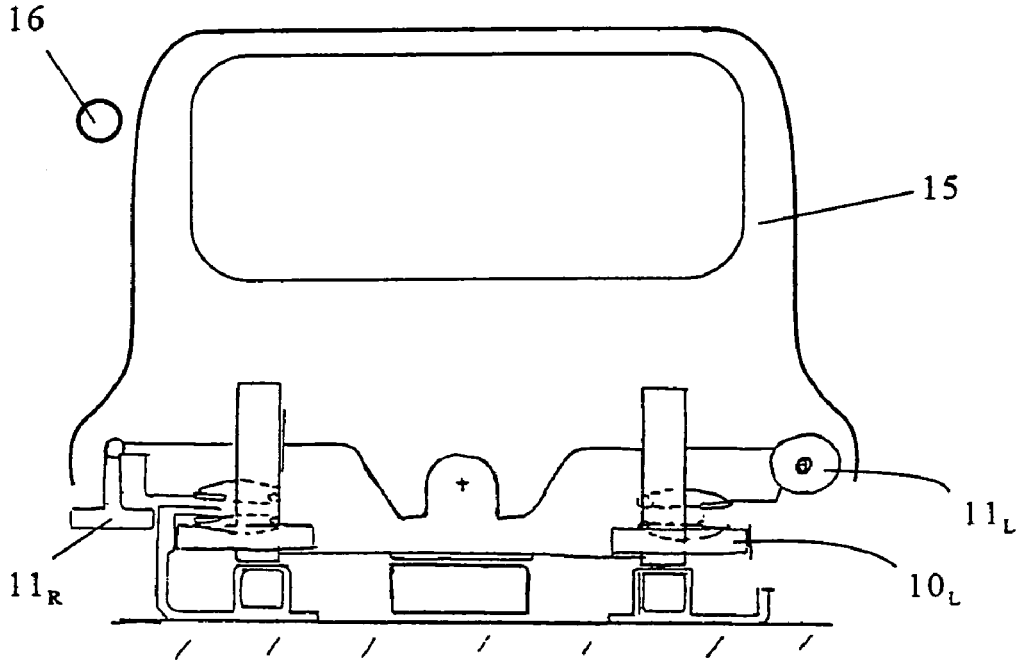
FIG. 4 is a schematical front view of a vehicle based on the guideway and chassis system of FIG. 1, within a switching zone.

Now with reference to FIG. 4 a vehicle with a cabin 15 is shown schematically within a switching zone. Like in FIG. 1, switching wheel 11R is in its active position while switching wheel 11L is in its passive position. Furthermore there is no longer any guide rail 5L in contact with guide wheel 10L. In order to ensure that the left part of the vehicle is not able to lift from the rails even if exposed to strong sidewinds, an auxiliary support structure like a fence or bar 16 is preferably arranged at a close horizontal distance from the cabin at the supported side of the same in each switching zone.

In applications of the invention where the vehicle is used for transport of personnel or valuable goods, the importance of functioning switching wheels is such that a control system be applied that at any switching point controls that one set of switching wheels has been lowered into its active position and locked. If the control system can not confirm that one set of switching wheels is in its active position, the vehicle is not allowed to enter the switching zone. In order to safeguard the persons or goods on board, the control system should therefore preferably be designed in a way such that the vehicle automatically stops if no set of switching wheels has been activated when a vehicle approaches a switching point. If for some reason e.g. the left hand side switching wheels fails to activate, then the right hand side should be activated and the vehicle brought through any number of right hand turns necessary to bring the vehicle to a service point. The control system may be designed in a number of ways, and does not constitute part of the present invention.

It is readily understood that the guideway and chassis system according to the invention is comparatively insensitive of varying weather conditions. This is due to the fact that the braking system is separated from and independent of the wheels and their interaction with the rails. Therefore the wheels may be optimized with respect to other factors, such as low noise generation and low wear. Typically the wheels are made of aluminium and/or durable synthetic materials and/or composite materials. The different types of wheels may of practical purposes be designed in different ways and with different dimensions. Thus the main wheels will normally be larger and heavier than the guide wheels. When switching wheels are incorporated, these will normally be even smaller and lighter than the guide wheels.

In case of heavy snowfall there will be a need for snow removal from the guideway, which may be performed partly by small snow ploughs or blades on each vehicle, partly by equipment specifically designed for this purpose. At light snowfall heat from the propulsion system will, in cases where the propulsion system includes linear motors, normally melt the snow continuously. Support structures elevated from the ground may be designed as virtually open structures that most of the snow will fall through.

As mentioned the open construction of the guideway without a covering "roof", allows a vertically very compact structure, the vertical dimension of which is not influenced by the diameter of the main wheels or other factors. Thus the main wheels may be dimensioned from aspect of comfort, economics and safety, and will typically have a diameter larger than the overall height of the guideway, which was priory not feasible. In practice the overall height of the guideway system is mainly determined by the vertical extension of the suspension for the guide wheels and the thickness of said wheels.

Furthermore the open structure without a central mainframe allows an integration between the cabin and the chassis that is unobtainable in the substantially closed system where all parts of the chassis is contained in a box-like structure and all parts of cabin is outside same box-structure, the main frame being the sole element that links them together.

One of the major advantages incorporated in the guideway and chassis system according to the invention, is the safe and tiltless connection between the guideway and the chassis/bogie combined with the ease of removing and replacing vehicles. At a service point there will typically be an area with no flanges on top of the guide rails 5, or a guideway with no end stop member, so that the vehicle may be lifted off the guideway with a small crane or wheeled off the guideway e.g. by hand force.

Advantages are also inherent with the fact that the vehicles need not include a motor, so the service requirement will be correspondingly modest. In addition the construction of the guideway and chassis according to the present invention allows very compact designs, and according to a preferred embodiment of the invention the entire guideway construction from the base for the rails 4 to the top of the flanges 6 is within a vertical distance of 0.40 meter and more preferred within 0.30 meter. Naturally the guideway and chassis according to the invention may be made with much larger dimensions if required for particular applications and/or purposes. For most applications, however, the challenge is to make the guideway and chassis as compact as possible without jeopardizing safety and reliability.

For use in large traffic systems, control systems need to be applied to ensure rapid, safe and reliable traffic handling. Such control systems however may be designed with conventional circuitry and based on known principles and do not constitute a part of the present invention.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A guideway and chassis system of wheel-based, rail running vehicles for passenger transportation, comprising a) a guideway system including substantially horizontal bases, two parallel rails, and mainly vertical guide rails extending along both sides of the rails, with mainly horizontal inward flanges at a vertical distance above the bases, and b) a chassis for a vehicle, said chassis including a set of main wheels arranged to run on said rails and a set of guide wheels arranged to bear against the guide rails to ensure the lateral position of the vehicle, and a set of switching wheels at both sides of the guide rails, said switching wheels being operable between a passive position where no switching wheel is in contact with any guide rail and an active position where the switching wheel at one side of the chassis bears against an exterior side of a corresponding guide rail, said flanges being localized closely above a top side of at least one of said guide wheels so as to restrict ability to upward vertical movement of the guide wheel, a width of the flanges being sufficiently small so as to not interfere with the main wheels, which extend vertically beyond the horizontal flanges, and said switching wheels being activated in a region or at a point of the guideway where at least a top part of each guide rail extending to a point of engagement for the switching wheels is thinner than a corresponding top part of the guide rail is at the switching points of the guideway.

2. The guideway and chassis system according to claim 1, wherein the switching wheels are arranged so as to not allow an active position of both a left hand and a right hand switching wheel simultaneously.

3. The guideway and chassis system according to claim 1, wherein the switching wheels are configured to be activated, monitored, and locked.

4. The guideway and chassis system according to claim 1, wherein at least one of (i) the rail and an adjacent guide rail are arranged as one integral unit and (ii) a lower edge of both of the guide rails has a substantially rigid connection to a common support structure for the guideway system.

5. The guideway and chassis system according to claim 1, wherein the flanges are arranged to interact with callipers constituting parts of a parking break, an emergency brake, or a combined parking brake and emergency brake.

6. The guideway and chassis system according to claim 1, wherein all of the wheels on the chassis are mounted on bogies.

7. The guideway and chassis system according to claim 1, further comprising an auxiliary support structure that is arranged in a switching zone for preventing a side of the chassis temporarily unsupported by the guide wheels from moving substantially in an upward direction, said auxiliary support structure being configured as a bar or a fence arranged above the supported guide wheels and in close horizontal proximity to a cabin supported by the chassis.

8. The guideway and chassis system according to claim w, the guideway further comprising an adapted propulsion system.

9. The guideway and chassis system according to claim 8, wherein the propulsion system is electrical.

10. The guideway and chassis system according to claim 9, wherein the electrical propulsion system includes a linear motor that is integrated with the guideway or with a support structure for the guideway, and is configured to interact with at least one metal plate rigidly attached to said chassis.

11. The guideway and chassis system according to claim 1, wherein an overall height of the guideway system is mainly determined by a vertical extension of a suspension for the guide wheels and a thickness of the guide wheels.

12. The guideway and chassis system according to claim 1, wherein an overall height of the guideway system from a base of rails to the top side of the flanges does not exceed 0.40 meter.

13. The guideway and chassis system according to claim 12, wherein the overall height of the guideway system from the base of the rails to the top side of the flanges is less than 0.30 meter.

14. The guideway and chassis system according to claim 1, wherein the switching wheels are movable in a vertical plane parallel to the corresponding guide rail so as to allow abutment with the guide rail.

* * * * *

UNITED STATES PATENT AND TRADEMARK OFFICE

CERTIFICATE OF CORRECTION

PATENT NO. : 7,624,685 B2
APPLICATION NO. : 10/555959
DATED : December 1, 2009
INVENTOR(S) : Andreasson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 580 days.

Signed and Sealed this

Twenty-sixth Day of October, 2010

David J. Kappos

David J. Kappos
*Director of the United States Patent and Trademark Office*